US006582537B1

(12) United States Patent
Engl et al.

(10) Patent No.: US 6,582,537 B1
(45) Date of Patent: Jun. 24, 2003

(54) METHOD FOR PRODUCING COLD-ROLLED BANDS OR SHEETS

(75) Inventors: Bernhard Engl, Dortmund (DE); Klaus Dieter Horn, Dortmund (DE); Klaus Dieter Schmidt, Dortmund (DE)

(73) Assignee: Thyssen Krupp Stahl AG, Dusseldorf (DE)

( * ) Notice: Subject to any disclaimer, the term of this patent is extended or adjusted under 35 U.S.C. 154(b) by 0 days.

(21) Appl. No.: 09/763,696

(22) PCT Filed: Sep. 6, 1999

(86) PCT No.: PCT/EP99/06533

§ 371 (c)(1),
(2), (4) Date: May 1, 2001

(87) PCT Pub. No.: WO00/14288

PCT Pub. Date: Mar. 16, 2000

(30) Foreign Application Priority Data

Sep. 8, 1998 (DE) ..... 198 40 788

(51) Int. Cl.[7] ..... C21D 8/02
(52) U.S. Cl. ..... 148/546; 148/603
(58) Field of Search ..... 148/603, 540, 148/541, 546, 547

(56) References Cited

U.S. PATENT DOCUMENTS

| | | | | |
|---|---|---|---|---|
| 3,857,740 A | * 12/1974 | Gondo et al. | ..... | 148/603 |
| 3,879,232 A | 4/1975 | Gondo et al. | | |
| 4,576,657 A | 3/1986 | Satoh | | |

FOREIGN PATENT DOCUMENTS

| | | | | |
|---|---|---|---|---|
| DE | 35 28 782 A | 2/1987 | | |
| DE | 38 030 64 C | 4/1989 | | |
| EP | 0 216 044 B | 4/1987 | | |
| JP | 355145123 A | * 11/1980 | ..... | 148/603 |
| JP | 61-238919 A | 10/1986 | | |
| JP | 62-139822 A | 6/1987 | | |
| JP | 362284016 A | * 12/1987 | ..... | 148/111 |
| JP | 5-239554 A | 9/1993 | | |

* cited by examiner

*Primary Examiner*—Deborah Yee
(74) *Attorney, Agent, or Firm*—Proskauer Rose LLP

(57) ABSTRACT

The present invention concerns a method for the production of cold-rolled bands or sheets from low-alloy steel with a maximum of 0.2% C, Al, Ti, V, Nb respectively and a maximum of 1% Si and Mn respectively, in addition to a portion of boron required for N binding (>0,78×N), the remainder being constituted by iron and unavoidable impurities, wherein said steel is cast after melting to slabs, thin slabs or a band, which are hot-rolled at a starting temperature above 1100° C. and at a final temperature below $Ar_3$ and wherein the hot band is then drawn and cold-rolled at a temperature below 650° C., whereupon the cold band is annealed independently of the degree of cold-rolling at a low temperature that could possibly vary depending on the composition of the steel and ranging from 520 to 780° C. during a period of time that is sufficiently long to allow for complete recrystallization. The method disclosed makes it possible to simplify manufacturing and to lower production costs associated with the manufacture of a completely recrystallized cold-rolled band or sheet.

7 Claims, 5 Drawing Sheets

METHOD FOR PRODUCING COLD-ROLLED BANDS OR SHEETS

The invention relates to a method for producing cold-rolled strips or sheets out of low-alloyed steels with a respective max. 0.2% of C, P, Al, Ti, V, Nb, S, B and a respective max. 1% Si and Mn, remainder iron and unavoidable impurities. After being melted, the steel is cast into slabs, thin slabs or strips, generally in a continuous casting procedure, and then hot-rolled, cold-rolled and subjected to recrystallizing annealing.

The annealing temperature level required for a complete recrystallization of the cold-rolled strip or sheet can be influenced in the preliminary stages of strip steel production. For example, it is known that the recrystallization temperature can be reduced via a high hot-strip coiling temperature and a high cold-rolling ration.

The object of the invention is to reduce the production outlay and associated manufacturing costs for generating a completely recrystallized, cold-rolled strip or sheet.

To achieve this object, the invention proposes that, in the generic procedure, the slabs or strips be hot-rolled at an initial temperature exceeding 1,100° C. and a final temperature lying under $Ar_3$, the hot strip be coiled at a temperature lying below 650° C., and the cold strip then be cold-rolled at a temperature which is nearly independent of the cold rolling ratio and as low as possible ranging from 500 to 750° C. for a time sufficient to ensure complete recrystallization.

The invention is based on the surprising determination that by the use of a reduced hot-roll final temperature and a low coiling temperature a complete recrystallisation of the cold-rolled strip can be obtained at a comparatively low temperature nearly independently of the cold rolling strain. A low temperature for recrystallization annealing saves energy and costs.

In addition to the alloy contents specified above, the steels may contain 0.01% of nitrogen and the quantity of boron (>0.78×N) required for nitrogen fixation. Beyond that, slight quantities of other alloying elements that have no negative impact on the recrystallization conditions are also permissible.

If possible, the hot-roll final temperature should lie 50° C. under Ar3, and the coiling temperature should preferably range from 300 to 600° C. IF-steels with a low carbon content of up to 0.01% or steels micro-alloyed with Ti, V, Nb can be completely recrystallization annealed in a temperature range of 600 to 780° C., while non-micro-alloyed steels can be completely recrystallization annealed at even lower temperatures ranging from 500 to 680° C., largely independently of the cold rolling level.

The invention will be explained in greater detail based on five examples.

Figure 1:
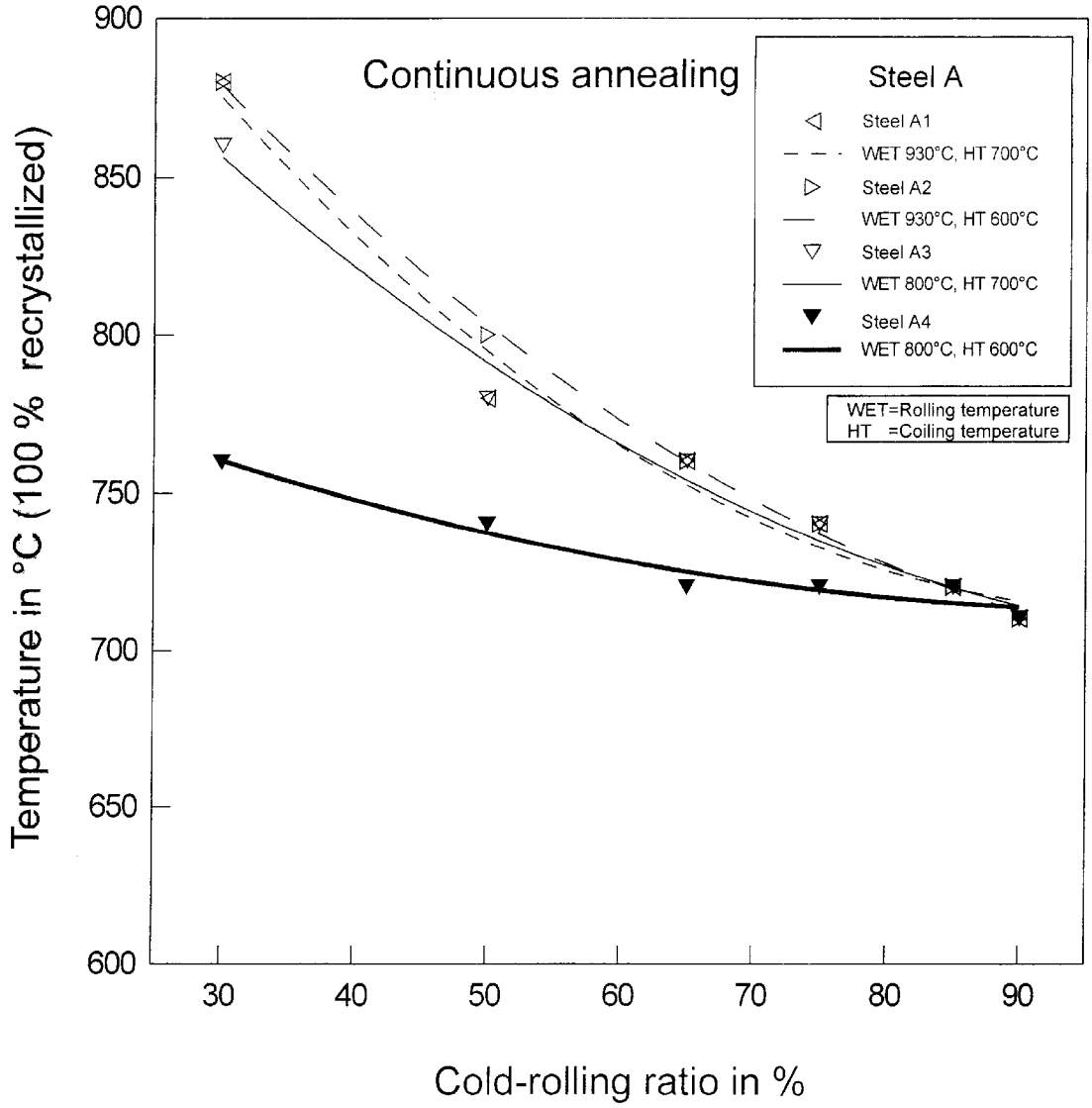
FIG. 1 shows the hot-roll and annealing conditions of steel A in a continuous casting installation.
Figure 2:
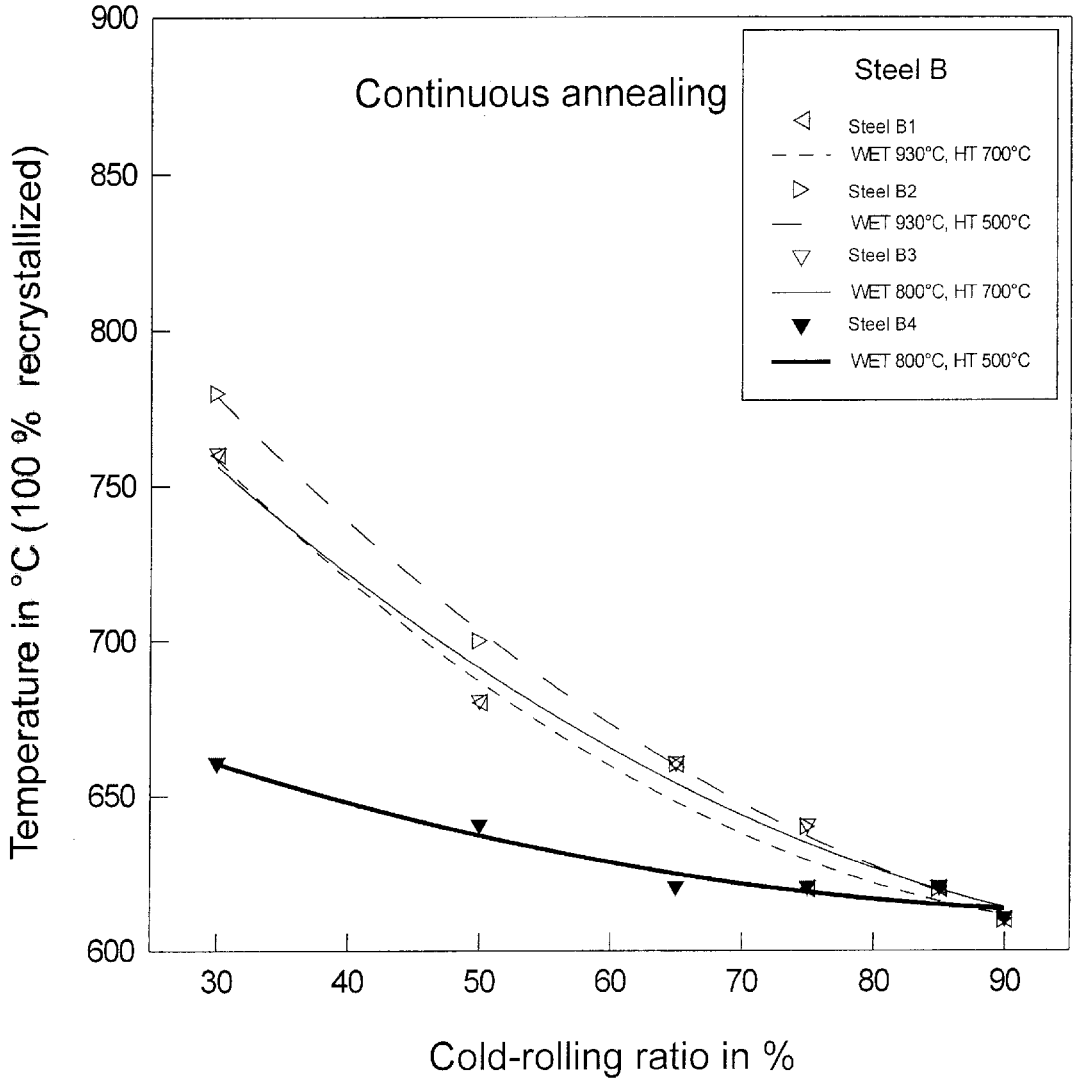
FIG. 2 shows the hot-roll and annealing conditions of steel B in a continuous casting installation.
Figure 3:
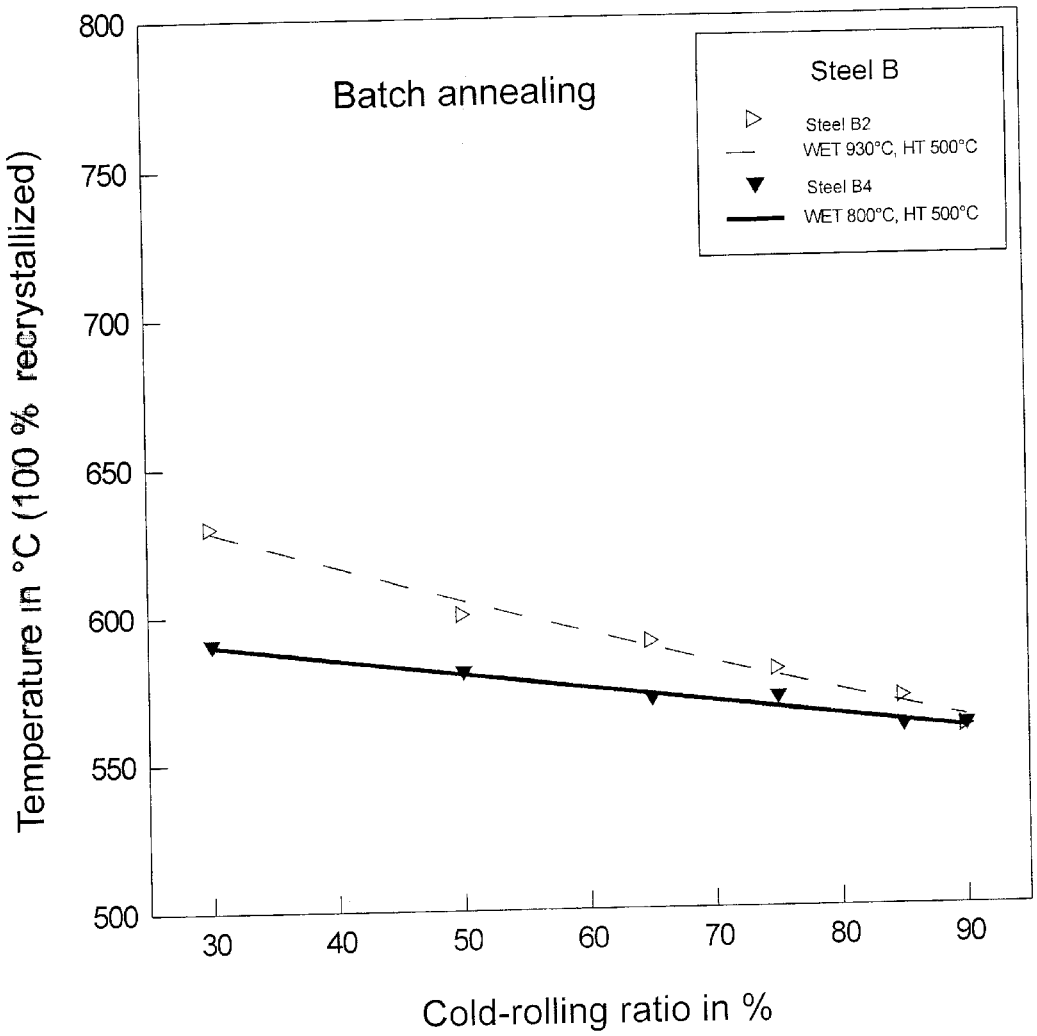
FIG. 3 shows the hot-roll and annealing conditions of steel B in a bath annealing installation.
Figure 4:
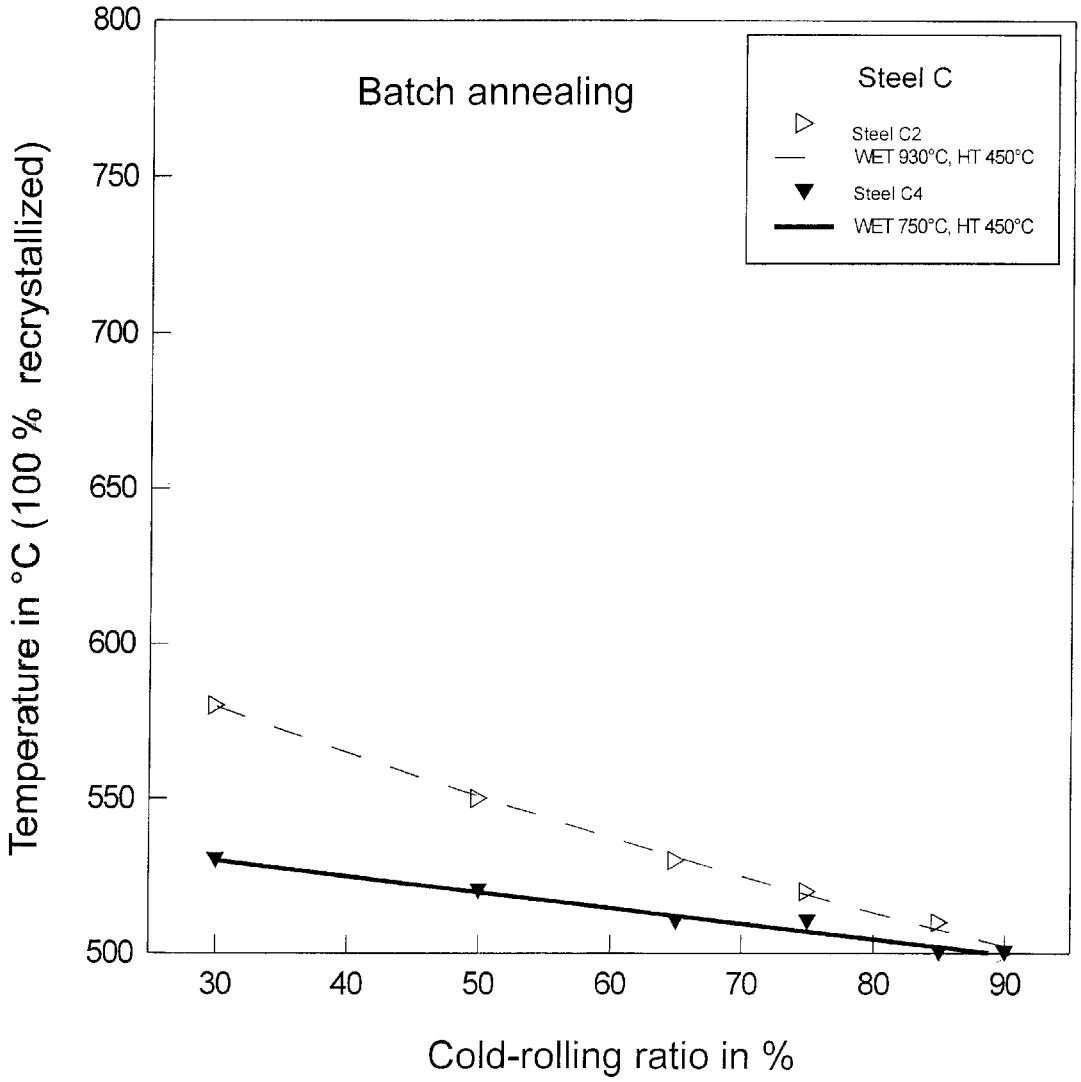
FIG. 4 shows the hot-roll and annealing conditions of steel C in a bath annealing installation.
Figure 5:
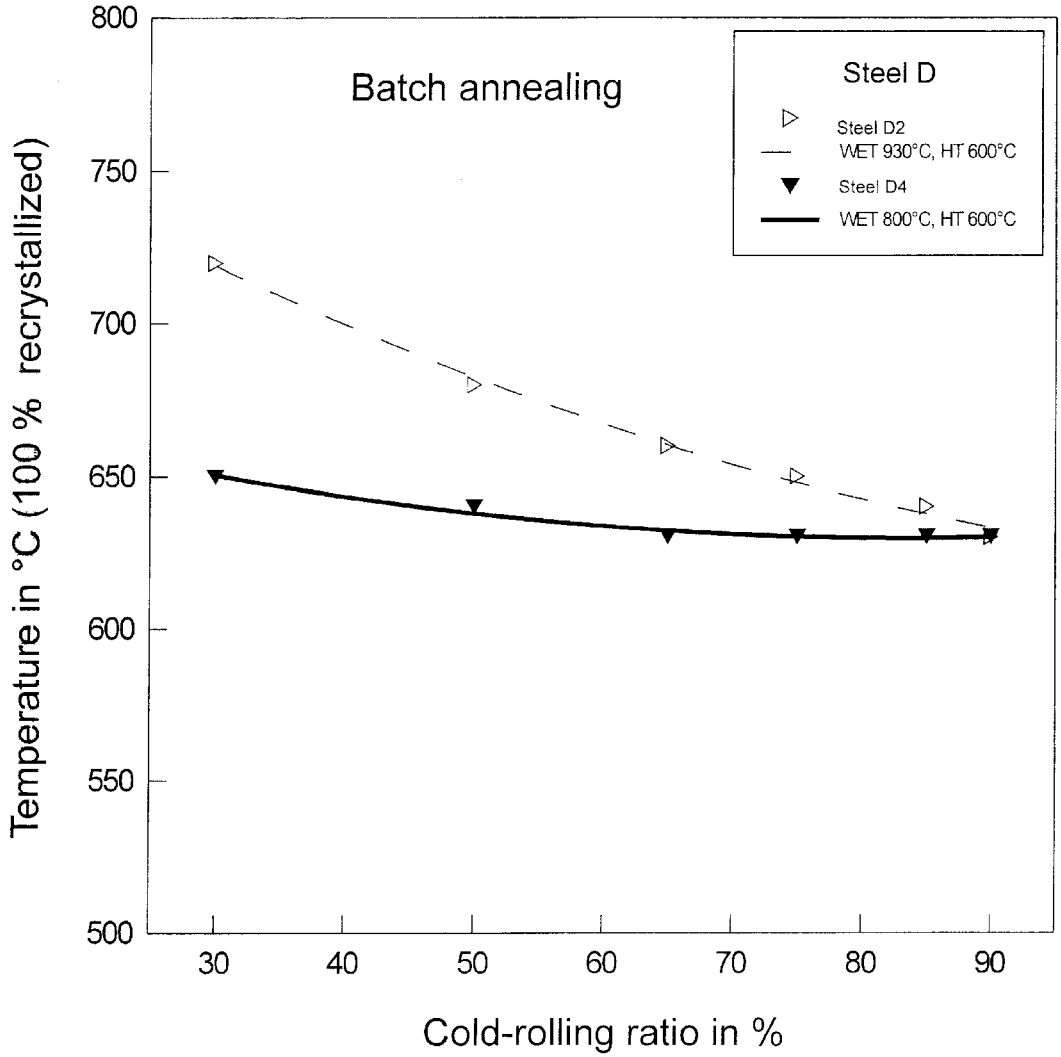
FIG. 5 shows the hot-roll and annealing conditions of steel D in a bath annealing installation.

Table 1 shows the chemical compositions of four deep-drawing steels A to D. FIGS. 1 to 5 each show the hot-roll and annealing conditions.

The curve progressions show that by combining a low hot-roll final temperature and a low coiling temperature in accordance with the invention, cold-rolled strip or sheet, examples A4 to C4, the recrystallization temperature in a a continuous casting installation (FIGS. 1 and 2) as well as in a bath annealing installation (FIGS. 3 to 5) can greatly be reduced, especially at a low cold-rolling level of 30 to 50%, relative to material of the same composition that was processed at a higher hot-roll final temperature and coiling temperature.

TABLE 1

| | Chemical Composition in % w/w | | | | | | | | |
|---|---|---|---|---|---|---|---|---|---|
| Steel | C | Si | Mn | P | S | Al | N | Ti | Nb |
| A | 0.003 | 0.01 | 0.08 | 0.008 | 0.005 | 0.021 | 0.0022 | 0.061 | — |
| B | 0.035 | 0.01 | 0.20 | 0.010 | 0.008 | 0.030 | 0.0039 | — | — |
| C | 0.003 | 0.01 | 0.15 | 0.006 | 0.004 | 0.001 | 0.0016 | — | — |
| D | 0.037 | 0.02 | 0.22 | 0.012 | 0.009 | 0.042 | 0.0045 | — | 0.030 |

What is claimed is:

1. A method for producing cold-rolled strips or sheets out of a low-alloyed steel containing a respective max. 0.2% of C, Al, Ti, V Nb, and a respective max. 1% Si and Mn, and optionally a quantity of boron (>0.78×N) required for N-setting, remainder iron and unavoidable impurities, comprising:

melting the low-alloyed steel;

casting the low alloyed steel into slabs, thin slabs or strips;

hot-rolling the slabs, thin slabs or strips at an initial temperature exceeding 1,100° C. and at a final temperature lying under $Ar_3$ to obtain a hot strip;

coiling the hot strip at a temperature of less than 650° C.;

cold rolling the hot strip at a total cold rolling degree of at most 50% to produce a cold-rolled strip; and annealing the cold strip for a time sufficient for complete recrystallization at a temperature ranging from 520 to 780° C.

2. A method according to claim 1, wherein cold rolling takes place at a cold-rolling ratios of between 30% and 50%.

3. A method according to claim 1, wherein the strip is subjected to one or more intermediate annealings during cold rolling between the cold-rolling steps.

4. A method according to claim 1, applied to the steels comprising <0.01% C and free of said micro-alloy elements, and to steels comprising any C content up to 0.2% and said micro-alloy elements, wherein the recrystallization annealing takes place in a continuous annealing installation at a temperature ranging from 700 to 780° C.

5. A method according to claim 1, applied to steels comprising more than 0.1% C and free of micro-alloy elements, wherein the recrystallization annealing takes place in a continuous annealing installation at a temperature ranging from 600 to 680° C.

6. A method according to claim 1, applied to steels comprising <0.01% C and free of micro-alloy elements, and to steels comprising any C content up to 0.2% and micro-alloy elements, wherein the recrystallization annealing takes place in a batch annealing installation at a temperature ranging from 600 to 680° C.

7. A method according to claim 1, applied to steels comprising more than 0.1% C and free of micro-alloy elements, wherein the recrystallization annealing takes place in a batch annealing installation at a temperature ranging from 520 to 600° C.

* * * * *